US006866370B2

(12) United States Patent
Jeanmaire

(10) Patent No.: US 6,866,370 B2
(45) Date of Patent: Mar. 15, 2005

(54) APPARATUS AND METHOD FOR IMPROVING GAS FLOW UNIFORMITY IN A CONTINUOUS STREAM INK JET PRINTER

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 65 days.

(21) Appl. No.: 10/156,617

(22) Filed: May 28, 2002

(65) Prior Publication Data

US 2003/0222950 A1 Dec. 4, 2003

(51) Int. Cl.[7] ..... B41J 2/09
(52) U.S. Cl. ..... 347/77
(58) Field of Search ..... 347/77, 73–76, 347/78–83, 5, 21

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,709,432 A | | 1/1973 | Robertson | |
| 4,097,872 A | * | 6/1978 | Giordano et al. | 347/21 |
| 4,190,844 A | | 2/1980 | Taylor | |
| 4,292,640 A | | 9/1981 | Lammers et al. | |
| 4,540,990 A | * | 9/1985 | Crean | 347/78 |
| 5,455,606 A | * | 10/1995 | Keeling et al. | 347/7 |
| 6,079,821 A | | 6/2000 | Chwalek et al. | |
| 6,224,180 B1 | * | 5/2001 | Pham-Van-Diep et al. | 347/2 |
| 6,508,542 B2 | * | 1/2003 | Sharma et al. | 347/77 |
| 6,572,222 B2 | * | 6/2003 | Hawkins et al. | 347/77 |

FOREIGN PATENT DOCUMENTS

| | | |
|---|---|---|
| EP | 1219429 | 7/2002 |
| EP | 1228874 | 8/2002 |
| GB | 1598779 | 9/1981 |
| JP | 58104758 | 6/1981 |

OTHER PUBLICATIONS

U.S. Appl. No. 09/751,232, filed Dec. 28, 2000, in the name of Jeanmaire et al.; and U.S. Appl. No. 09/750,946, filed Dec. 28, 2000, in the name of Jeanmaire et al.

* cited by examiner

*Primary Examiner*—K. Feggins
(74) *Attorney, Agent, or Firm*—William R. Zimmerli

(57) ABSTRACT

A method of enhancing print quality of a continuous ink jet printing device and such a printing device in which selected droplets in a stream of droplets are selectively deflected to impinge on a print medium, the method including the steps of providing a plurality of ink droplets, each printing ink-droplet being substantially same size, providing a gas flow that deflects the plurality of ink droplets, monitoring uniformity of the gas flow, and adjusting a flow characteristic of the gas flow based on the monitored uniformity. The step of adjusting flow characteristic of the gas flow is attained by changing flow rate of the gas flow or flow area of the outlet. In one embodiment, the step of monitoring uniformity of gas flow includes monitoring trajectory paths of the deflected plurality of ink droplets.

35 Claims, 6 Drawing Sheets

APPARATUS AND METHOD FOR IMPROVING GAS FLOW UNIFORMITY IN A CONTINUOUS STREAM INK JET PRINTER

CROSS REFERENCE TO RELATED APPLICATIONS

Reference is made to commonly assigned, pending U.S. Ser. No. 09/751,232, filed December 2000, entitled "A CONTINUOUS INK-JET PRINTING METHOD AND APPARATUS"; and commonly assigned, pending U.S. Ser. No. 09/750,946, filed Dec. 28, 2000, entitled "PRINTHEAD HAVING GAS FLOW INK DROPLET SEPARATION AND METHOD OF DIVERGING INK DROPLETS".

FIELD OF THE INVENTION

This invention relates generally to the field of printing devices, and in particular to improving the quality of print yielded from continuous stream ink jet printers in which a liquid ink stream is broken into droplets, some of which are selectively deflected by a gas stream.

BACKGROUND OF THE INVENTION

Traditionally, digitally-controlled ink jet color printing is accomplished by one of two technologies. Both can utilize independent ink supplies for each of the colors of ink provided. Ink is fed through channels formed in the printhead and each channel includes a nozzle from which droplets of ink are selectively ejected and deposited upon a print medium, such as paper. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "drop on demand" (DOD) ink jet printing, provides ink droplets for impact upon a recording surface using a pressurization actuator, such as a thermal actuator, piezoelectric actuator, or the like. Selective activation of the actuator causes the formation and ejection of a flying ink droplet that crosses the space between the printhead and the print media and strikes the print media. The formation of printed images is achieved by controlling the individual formation of ink droplets as required to create the desired image. Typically, a slight negative pressure within each channel keeps the ink from inadvertently escaping through the nozzle, and also forms a slightly concave meniscus at the nozzle helping to keep the nozzle clean.

With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric ceramics are lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no printing is desired, the ink droplets are deflected into an ink capturing mechanism and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism. Typically, continuous ink jet printing devices are faster than droplet on demand devices and can produce high quality printed images and graphics.

U.S. Pat. No. 1,941,001, issued to Hansell, and U.S. Pat. No. 3,373,437 issued to Sweet et al., each disclose an array of continuous ink jet nozzles wherein ink droplets to be printed are selectively charged and deflected towards the recording medium. This technique is known as "binary deflection" continuous ink jet printing.

Conventional continuous ink jet printers that utilize electrostatic charging devices and deflector plates require many components and large spatial volumes in which to operate. This results in continuous ink jet printheads and printers that are complicated, have high voltage requirements, are difficult to manufacture, and are difficult to control.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher.

U.S. Pat. No. 3,709,432, issued to Robertson, discloses a method and apparatus for stimulating a filament of ink to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a print media. This type of printhead is sensitive to the uniformity of the air flow, and thus can produce inconsistent print quality.

U.S. Pat. No. 4,190,844, issued to Taylor discloses a continuous ink jet printer in which a printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time. Unfortunately, such printing methods require a separate pneumatic deflector for each nozzle in the printhead. Since such deflectors are relatively slow in action, the printing speed is low relative to current, commercial ink jet systems. Additionally, such printheads are sensitive to the uniformity of the air flow, and thus can produce inconsistent print quality.

U.S. Pat. No. 4,292,640 issued to Lammers et al. discloses the use of a closed loop servo to regulate the flow rate of laminar air in a aspirated continuous-ink-jet printer. In this apparatus, the air flow is co-linear with respect to the droplet streams, and a time-of-flight sensing is used to provide a control signal responsive to droplet velocity. As such, the air flow does not function to give a constant droplet deflection angle or provide uniformity of air flow.

SUMMARY OF THE INVENTION

In the above regard, the constant air flow used to deflect the droplets in a continuous inkjet printhead should be provided in a uniform manner to all jets in the printhead. Otherwise, non-uniform air flow can cause improper deflection of the droplets at any given time causing droplet to droplet variation in the location of printing on the print medium thereby reducing the print quality.

Therefore, the primary advantage of the present invention is in improving the quality of printing from of a continuous ink jet printhead by improving gas flow uniformity, so as to allow consistent control of the deflection of the droplets.

The above noted and other advantages are attained in accordance with one embodiment of the present invention by a method of enhancing print quality of a continuous ink jet printing device in which selected droplets in a stream of droplets are selectively deflected to impinge on a print medium including the steps of providing a stream of plurality of ink droplets, providing a gas flow that deflects the plurality of ink droplets, monitoring uniformity of the gas flow, and adjusting a flow characteristic of the gas flow based on the monitored uniformity of the gas flow.

The step of adjusting flow characteristic of the gas flow may be attained various ways, however, in the embodiments of the invention presented here, the step of adjusting flow characteristic of the gas flow is attained by increasing or decreasing flow rate of the gas flow. In one embodiment of the invention, at least one of a flow rate of the gas flow relative to a droplet stream is adjusted by varying a flow area of the gas outlet. In another embodiment, the step of adjusting flow characteristic of the gas flow is attained by generating an acoustic wave to oppose the gas flow. In still another embodiment, the step of adjusting flow characteristic of the gas flow is attained by actuating an adjustment mechanism that adjustably varies at least one of a flow rate of the gas flow and a flow area of the outlet while in another embodiment, the step of adjusting flow characteristic of the gas flow is attained by precision machining the outlet.

In accordance with the various embodiments of the present invention, the step of monitoring uniformity of gas flow is attained by a hot-wire sensor or by monitoring trajectory paths of the deflected plurality of ink droplets. In this regard, in such an embodiment, lack of variation in trajectory paths of the deflected plurality of ink droplets is indicative of uniform gas flow, and presence of variation in trajectory paths of the plurality of ink droplets is indicative of non-uniform gas flow. The trajectory paths of the deflected plurality of ink droplets may be monitored by providing a laser beam across the gas flow and monitoring trajectory paths of the plurality of ink droplets relative to the laser beam. Alternatively or in addition thereto, the step of monitoring trajectory paths of the deflected plurality of ink droplets may include impacting the deflected plurality of ink droplets on a print media and comparing location of the plurality of ink droplets on the print media.

In accordance with another aspect of the present invention, a continuous ink jet printing device is provided for printing an image in which selected droplets in a stream of droplets are selectively deflected to impinge on a print medium, the printing device including an ink droplet forming mechanism adapted to provide a stream of plurality of ink droplets, each ink droplet being substantially same size, a droplet deflector with an outlet, the droplet deflector being adapted to generate a gas flow provided through the outlet that deflects the plurality of ink droplets, a monitoring mechanism adapted to monitor uniformity of the gas flow from the droplet deflector, and an adjustment mechanism operatively coupled to the droplet deflector to adjust a flow characteristic of the gas flow based on the monitored uniformity of the gas flow.

In one embodiment, of the printing device, the adjustment mechanism changes the flow rate of the gas flow generated by the droplet deflector and/or a flow area of the outlet. In this regard, the adjustment mechanism may increase or decrease the flow rate of the gas flow. Alternatively, the adjustment mechanism may generate an acoustic wave to oppose the gas flow. In yet another embodiment, the adjustment mechanism includes a baffle which is movable between a retracted position and an extended position to vary the flow rate of the gas flow generated by the droplet deflector or the flow area of the outlet, the baffle being movable by an actuator.

In accordance with another embodiment of the present invention, the monitoring mechanism of the printing device may include a hot-wire sensor. In another embodiment, the monitoring mechanism may be adapted to monitor trajectory paths of the deflected plurality of ink droplets, the lack of variation in trajectory paths of the deflected plurality of ink droplets being indicative of uniform gas flow, and presence of variation in trajectory paths of the plurality of ink droplets being indicative of non-uniform gas flow. In another embodiment, the monitoring mechanism includes a laser that provides a laser beam across the gas flow to allow monitoring trajectory paths of the plurality of ink droplets relative to the laser beam.

Other features and advantages of the present invention will become apparent from the following description of the preferred embodiment of the invention and the accompanying drawings.

DETAILED DESCRIPTION OF THE INVENTION

Figure 1:
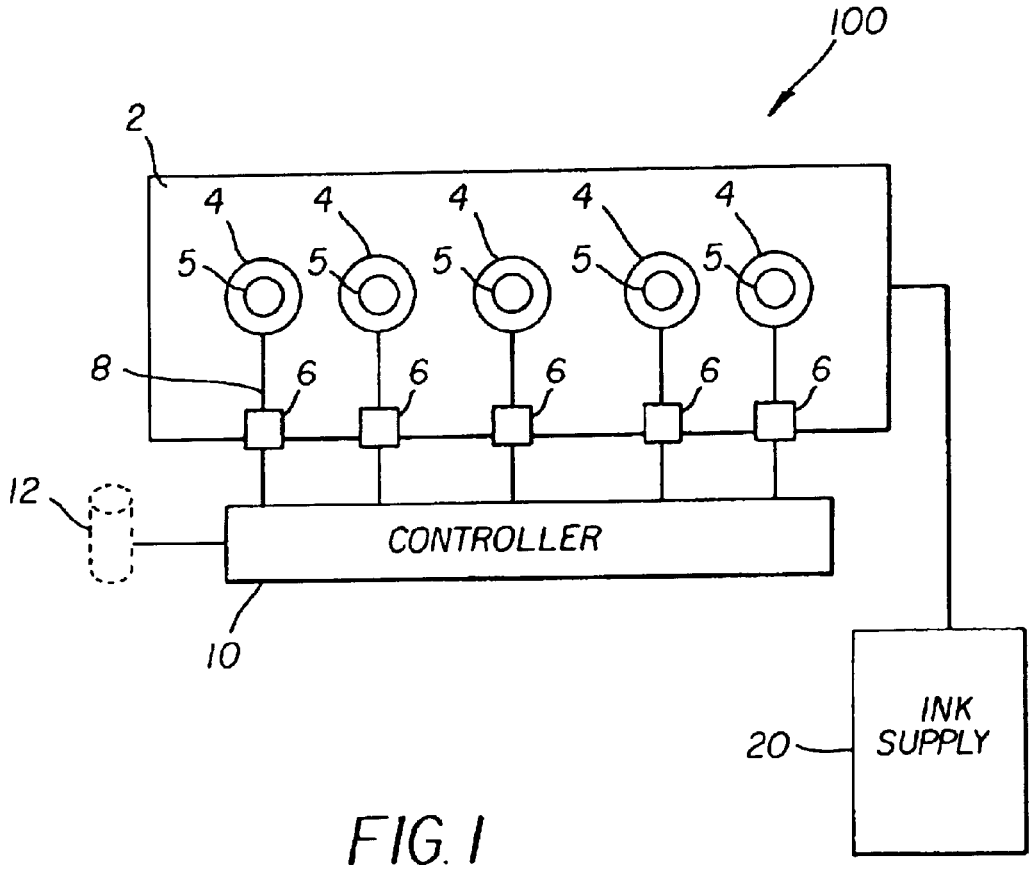
FIG. 1 is a schematic view of a printing device in accordance with an embodiment of the present invention.

FIG. 1 illustrates a print head mechanism in accordance with a preferred embodiment of the invention. Mechanism 100 includes printhead 2, at least one ink supply 20, and controller 10. Although mechanism 100 is illustrated schematically and not to scale for the sake of clarity, one of ordinary skill in the art will be able to readily determine the specific size and interconnections of the elements. Printhead 2 can be formed from a semiconductor material, such as silicon, using known semiconductor fabrication techniques, such as complementary metal oxide semiconductor (CMOS) fabrication techniques and micro electro mechanical structure (MEMS) fabrication techniques, or from any materials using any known or future fabrication techniques and incorporates a thermal actuator.

Plural nozzles 5 are formed in printhead 2 to be in fluid communication with ink supply 20 through ink passages (not shown) also formed in printhead 2. Each ink supply 20 may contain a different color ink for color printing. Any number of ink supplies 20 and corresponding nozzles 5 can be used in order to provide color printing using three or more ink colors. Additionally, black and white or single color printing may be accomplished using a single ink supply 20. Of course, the separation between nozzles 5 can be adjusted in accordance with the particular application to deliver the desired resolution.

Heaters 4 are positioned on printhead 2 around a corresponding nozzle 5. Although each heater 4 may be disposed radially away from an edge of a corresponding nozzle 5, heaters 4 are preferably disposed close to an edge of a corresponding nozzle 5 in a concentric manner. In a preferred embodiment, heater 4 is formed in a substantially circular or ring shape. However, heater 4 may be formed in a partial ring, square, or any appropriate shape. Heater 4 can include an electric resistive heating element electrically connected to pad 6 via conductor 8 or any other type of heating element.

Conductors 8 and pads 6 may be at least partially formed or positioned on printhead 2 and provide an electrical connection between controller 10 and heaters 4. Alternatively, the electrical connection between controller 10 and heaters 4 may be accomplished in any known manner. Controller 10 may be a logic controller, programmable microprocessor, or the like, operable to control heaters 4 and other components of mechanism 100 as described below.

Figure 2:
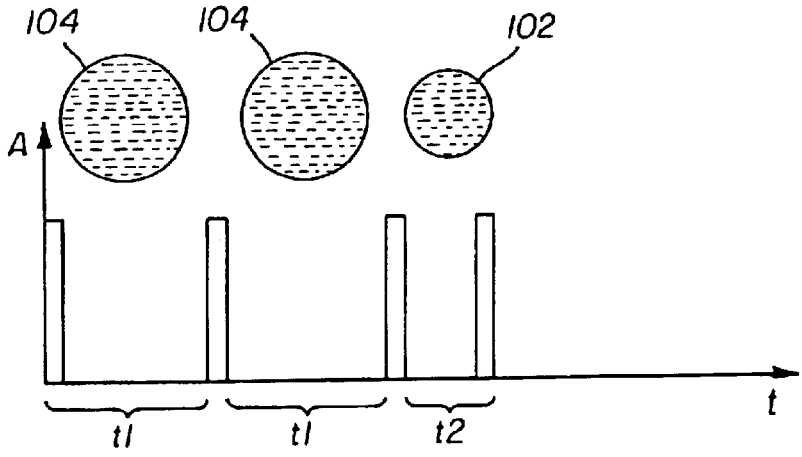
FIG. 2 is a graph of an example of heater activation frequency and the resulting ink droplets.

FIG. 2 illustrates an example of the activation signal frequency provided by controller 10 to one of heaters 4, plotted as signal amplitude versus time, and the resulting individual ink droplets 102 and 104. A high frequency, e.g., a frequency resulting from time t2 between pulses, of activation of heater 4 results in a small volume droplet 102 and a low frequency, e.g., frequency resulting from time t1 between pulses, of activation of heater 4 results in large volume droplets 104. Activation of heaters 4 may be controlled independently based on the ink color required, movement of printhead 20 relative to a print media P and an image to be printed. A plurality of droplets may be created having a plurality of volumes, including a mid-range activation frequency of heater 4 resulting in a medium volume droplet. As such, reference below to large volume droplets 104 and small volume droplets 102 is for example purposes only and should not be interpreted as being limiting in any manner.

Figure 3A:
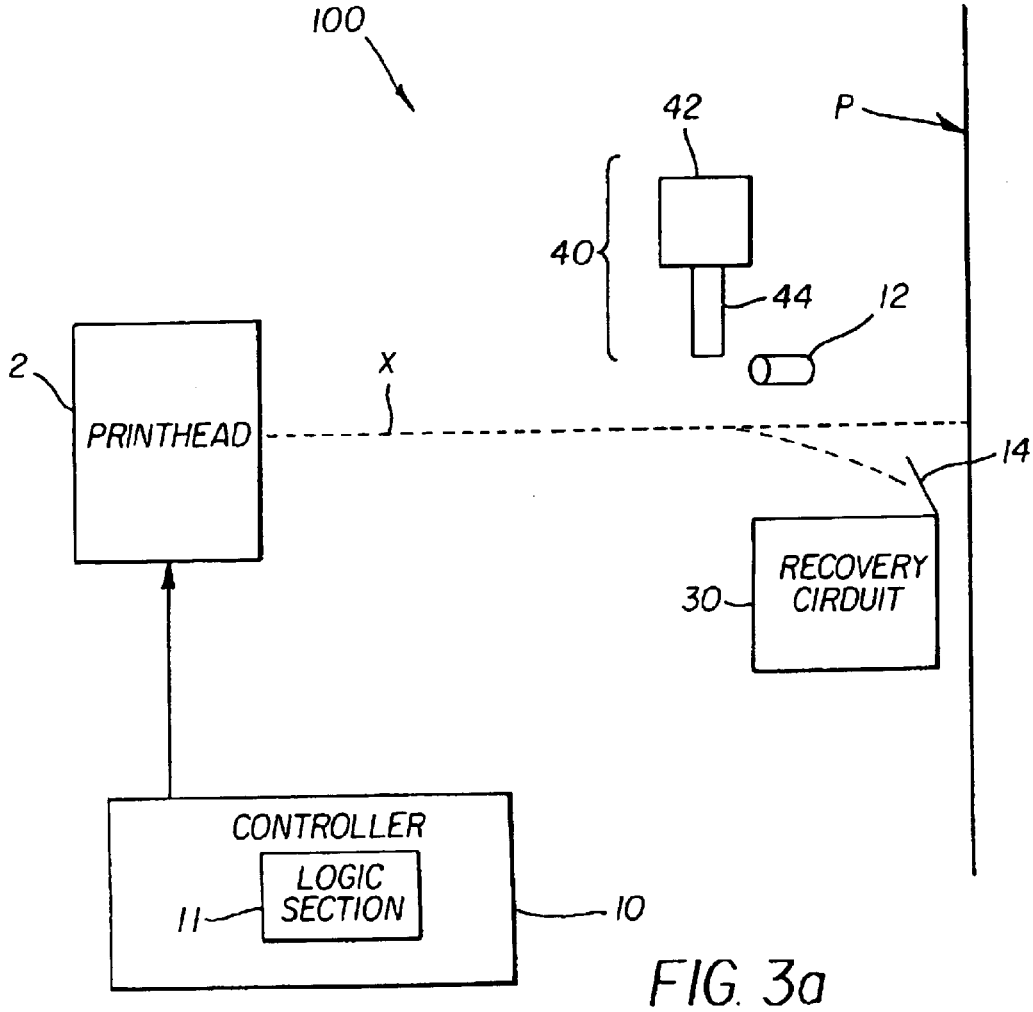
FIG. 3*a* is a schematic side view of a printing device of an embodiment of the present invention illustrating the ink droplet trajectory path.

FIG. 3*a* illustrates an ink jet print apparatus of the preferred embodiment. Large volume ink droplets 104 and small volume ink droplets 102 are ejected in a stream from printhead 2 along ejection path X, the printhead 2 being shown in a profile view. Thus, the printhead 2 as shown in FIG. 1 with the plural nozzles 5 are provided extending into the page of FIG. 3 so that the ink droplets are ejected in a stream from the plural nozzles 5 along ejection path X. Droplet deflector 40 applies a force to ink droplets 102 and 104 as the ink droplets travel along path X. In this regard, the droplet deflector 40 is also shown in a profile view with the plenum 44 which extends into the page of FIG. 3 so that the force provided by the droplet deflector 40 acts upon the droplet streams provided by the plural nozzles 5 of the printhead 2. The force provided by droplet deflector 40 interacts with ink droplets 102 and 104 along path X for the droplet streams provided by the plural nozzles 5, causing the ink droplets 102 and 104 to be deflected. As ink droplets 102 and 104 have different volumes and masses, the force causes small droplets 102 to separate from large droplets 104 with small droplets 102 diverging from path X along deflection path to be captured by the gutter 14 and directed to ink recovery conduit 30, while large droplets 104 are only slightly affected by the force. The effect of the force is relatively small for large droplets 104 and thus, large droplets 104 remain traveling substantially along path X so as to continue and impact on print media P. Alternatively, large droplets 104 can be deflected slightly and begin traveling along path K, as discussed below with reference to FIG. 3*b*.

Droplet deflector 40 can include a pressurized gas source 42 that provides the force in the form of a gas flow. Gas source 42 can be a fan for moving ambient air or any other source of pressurized gas. Plenum 44 is coupled to gas source 42 to direct the flow of gas in a desired manner. An outlet end of plenum 44 is positioned proximate path X. Ink recovery conduit 30 is disposed substantially in opposition to plenum 44 to facilitate recovery of non-printed, i.e., deflected ink droplets for subsequent use. Of course, there can be a separate droplet deflection mechanism and ink recovery conduit for each ink color.

In operation, a print media P is transported in a direction transverse to path X in a known manner. Transport of print media P is coordinated with operation of printhead 2 using controller 10 in a known manner. Pressurized ink is ejected through nozzles 5 creating filaments of ink. Heaters 4 are selectively activated at various frequencies causing the filaments to break up into streams of individual ink droplets 102 and 104 as described above.

During printing, droplet deflector 40 is operated. As gas exiting the outlet of plenum 44 interacts with the stream of ink droplets, the individual ink droplets separate depending on the velocity and mass of each droplet. Accordingly, gas source 42 can be adjusted to permit large volume droplets 104 to strike print media P while small volume droplets 102 are deflected into catcher or gutter 14 and collected in recovery conduit 30 as previously described. Accordingly, heaters 4 can be controlled in a coordinated manner to cause ink of various colors to impinge on print media P to form a desired image. Alternatively, deflected droplets can impinge on media P and non-deflected droplets can be recovered.

Figure 3B:
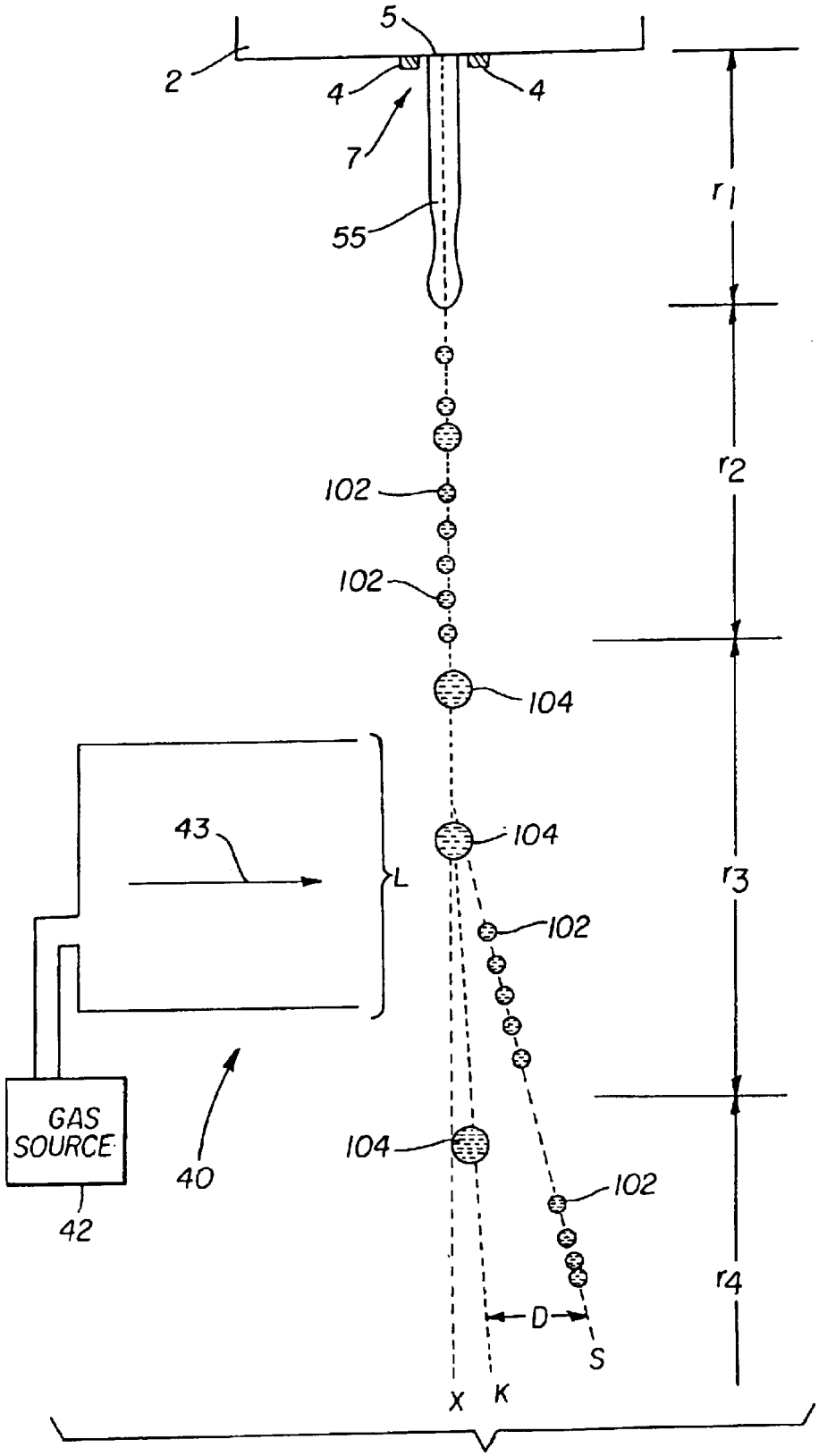
FIG. 3*b* is a schematic side view of a printing device of an embodiment of the present invention illustrating the ink droplet trajectory path.

Referring to FIG. 3*b*, printhead 2 is operatively associated with droplet deflector 40 which separates droplets into printing or non-printing paths according to drop volume. Ink is ejected through nozzle 5 in printhead 2, creating a filament of working fluid 55 moving substantially perpendicular to printhead 2 along axis X. The physical region over which the filament of working fluid 55 is intact is designated as $r_1$. Heater 4 (ink droplet forming mechanism 21) is selectively activated at various frequencies according to image data, causing filament of working fluid 55 to break up into a stream of individual ink droplets 102, 104. This region is designated as $r_2$. Following region $r_2$, drop formation is complete in region $r_3$, such that at the distance from the printhead 2 that droplet deflector 40 is positioned, droplets 102, 104 are substantially in two size classes: small droplets 102 and large droplets 104. Droplet deflector 40 includes a force 43 provided by a gas flow continuously applied substantially perpendicular to axis X. The force 43 acts over distance L, which is less than or equal to distance $r_3$. Large drops 104 have a greater mass and more momentum than small volume drops 102. As gas force 43 interacts with the stream of ink droplets 102, 104, the individual ink droplets separate depending on each droplets volume and mass. Accordingly, the gas flow rate can be adjusted to sufficient differentiation D in the small droplet path S from the large droplet path K, permitting large drops 104 to strike print media W while small drops 102 are captured by ink catcher 14. This can be accomplished by positioning catcher 14 in path S. Alternatively, small drops 102 can be permitted to strike print media W while large drops 104 are collected by catcher 14. This can be accomplished by positioning catcher 14 in path K (or path X depending on the amount of deflection of large droplets 104).

An amount of separation D between the large droplets 104 and the small droplets 102 will not only depend on their relative size but also the velocity, density, and viscosity of the gas flow producing force 43; the velocity and density of the large droplets 104 and small droplets 102; and the interaction distance (shown as L in FIG. 3) over which the large droplets 104 and the small droplets 102 interact with the gas flow 43.

Large volume droplets 104 and small volume droplets 102 can be of any appropriate relative size. However, the droplet size is primarily determined by ink flow rate through nozzles 5 and the frequency at which heaters 4 are cycled. The flow rate is primarily determined by the geometric properties of nozzles 5 such as nozzle diameter and length, pressure applied to the ink, and the fluidic properties of the ink such as ink viscosity, density, and surface tension. As such, typical ink droplet sizes may range in site from 1 to 10,000 picoliters.

Although a wide range of droplet sizes is possible, at typical ink flow rates, for a 9 micron diameter nozzle, large volume droplets 104 can be formed by pulsing heaters 4 at a repetition rate of about 10 kHz, thereby producing droplets of about 60 microns in diameter. Small volume droplets 102 can be formed by cycling heaters 4 at a frequency of about 150 kHz, producing droplets that are about 25 microns in diameter. These droplets typically travel at an initial velocity of 14 m/s. Even with the above droplet velocity and sizes, a wide range of separation distances between large volume droplets 104 and small volume droplets 102 after deflection is possible depending on the physical properties of the gas used, the velocity of the gas and the distance over which the gas interacts with droplets 102 and 104. For example, when using air as the gas, typical air velocities may range from, but are not limited to 1 to 10 m/s while interaction distances may range from, but are not limited to, 0.1 to 10 mm. Gases, including air, nitrogen, etc., having different densities and viscosities can be used for deflection.

It follows from the above that proper separation and displacement of the ink droplets from the plural nozzles 5, and thus, the quality of the print on print media P is largely dependent on the flow characteristics of the gas flow provided by the gas source 42 through the plenum 44 including the uniformity of gas flow. For example, a small non-uniformity in the gas flow may cause ink droplets from one or more of the plural nozzles 5 to be improperly deflected so that a droplet that is intended to go into the recovery conduit 30 actually impinges upon the print media P. Alternatively or in addition, small non-uniformity in the gas flow may cause ink droplets from one or more of the plural nozzles 5 to be improperly deflected so that a droplet that is intended to impinge upon the print media P is improperly diverted into the recovery conduit 30. Furthermore, small non-uniformity in the gas flow may cause ink droplets from one or more of the plural nozzles 5 to be improperly deflected so that droplets that impinge on the print media P are not properly positioned.

Figure 4:
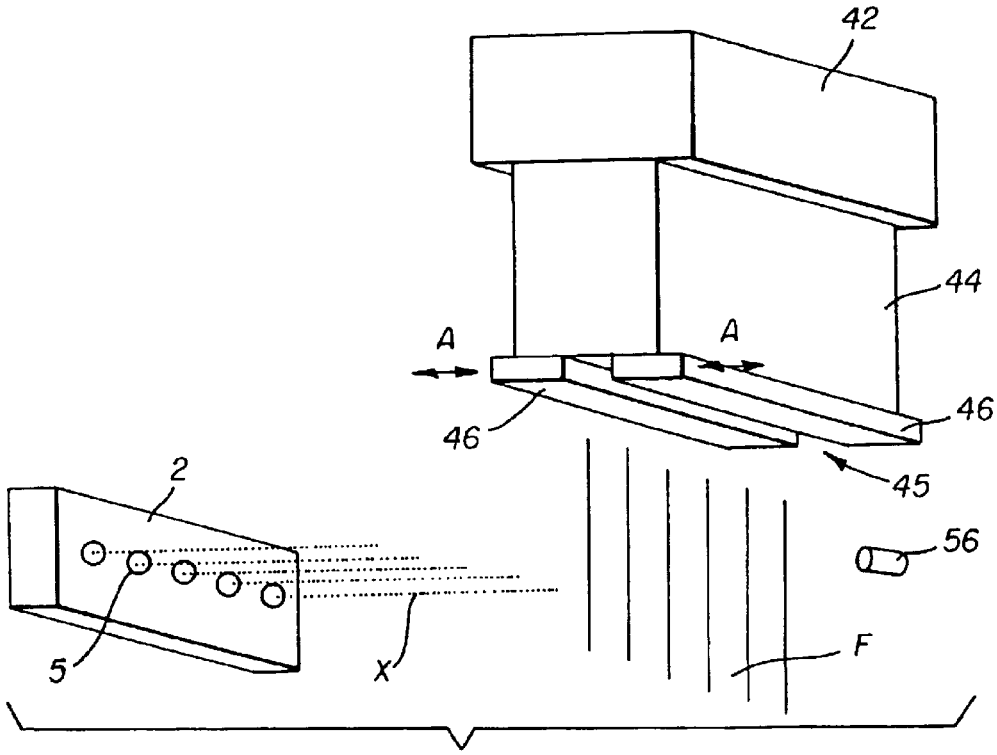
FIG. 4 is a perspective view of the print head and the deflector system in accordance with an embodiment of the present invention including a monitoring mechanism and an adjustment mechanism.

The importance of providing and maintaining a uniform gas flow is more readily apparent in FIG. 4 which shows an enlarged perspective view of various components shown in FIG. 3. The continuous ink jet printing device 100 including the ink droplet forming mechanism having printhead 2, heaters 4 and plural nozzles 5 is initially operated to provide a stream of plurality of ink droplets from each of the nozzles 5, each ink droplet being substantially same size, whether they are large droplets 104 or small droplets 102 so that the droplets should be deflected the same amounts by the droplet deflector 40. The droplet deflector 40 with an outlet 45 on the plenum 44 is operated to generate gas flow F provided through the outlet 45 that deflects the plurality of ink droplets. If the gas flow F is not uniform, any one or more of the stream of ink droplets may be improperly diverted in the manner described above which will result in diminished print quality. Therefore, in accordance with the present invention, the continuous ink jet printing device 100 is also provided with a monitoring mechanism adapted to monitor uniformity of the gas flow F from the plenum 44 of the droplet deflector 40, and an adjustment mechanism that adjusts the flow characteristic based on the monitored uniformity as described below.

The monitoring mechanism of the printing device 100 of the present embodiment as shown in FIG. 3 includes sensor 12 which may be a hot-wire sensor provided slightly below the outlet 45 of the plenum 44 but in a position in which it does not interfere with the flow of gas from plenum 44. The sensor 12 senses and monitors the gas flow F and provides a signal to the controller 10 indicative of the flow characteristic being measured. As can be appreciated, the flow characteristic is preferably the flow rate of the gas flow F across the outlet 45 of the plenum 44 which is indicative of the uniformity of the gas flow F. In this regard, to increase accuracy of the monitored uniformity of the gas flow F, an array of sensors (not shown) may be provided instead of the single sensor shown.

In the illustrated embodiment of the printing device 100 shown in FIGS. 3 and 4, the adjustment mechanism is a pair of baffles 46 positioned at the outlet 45 of the plenum 44. As clearly illustrated in FIG. 4, these baffles 46 are movable as indicated by arrows A to change the flow area of the outlet 45, thereby allowing the gas flow F to be maintained at a constant value. In this regard, the baffles 46 are movable between a retracted position in which the flow area of the outlet 45 is maximized, and an extended position in which the flow area of the outlet 45 is minimized. This adjustability of the baffles 46 may be attained by one or more actuators (not shown) connected to the baffles 46. In this regard, the one or more actuators for adjusting the baffles 46 may be piezoelectric actuators, MEMs actuators, electromagnetic solenoids, or any other type of actuators.

The above noted baffles 46 may be feedback controlled by the controller 10 which may be connected to the one or more actuators for operating the baffles 46. In this regard, the controller may include logic for receiving the signal from sensor 12 and for determining an adjustment value based on the signal. For example, the logic can include a lookup table having corresponding adjustment value for each signal value or for each range of such values so that the actuators for the adjustment mechanism may be operated to improve the uniformity of the gas flow F. In this regard, the amount of adjustment can be determined mathematically or through experimentation and be stored as a lookup table, a linear or non-linear mathematical formula, or the like. Controller 10 can include any necessary logic in logic section 11 for accurately receiving and processing the signal indicative of the uniformity of the gas flow F, such as time based filters, averaging algorithms, or the like. Thus, in the above described manner, the present invention allows the adjustment of the flow characteristic of the gas flow F based on the monitored uniformity, resulting in improved uniformity of the gas flow F.

It should be noted that the above described embodiment of the present invention is merely one example and other embodiments, especially of the monitoring mechanism and the adjustment mechanism, are described herein below as additional examples. However, it should be understood that the present invention is not limited thereto.

In other embodiments of the present invention, the monitoring mechanism may be adapted to monitor trajectory paths of the deflected plurality of ink droplets. Such monitoring of the trajectory paths provides an accurate indication of the uniformity of the gas flow F across the outlet 45 of the plenum 44 if the ink droplets provided by each of the plural nozzles 5 have substantially the same velocity and volume. If one area or region of the air flow F varies relative to the other regions, the ink droplets from one or more of the plural nozzles 5 would be deflected along a different trajectory path than the ink droplets from the other nozzles. The presence of variation in trajectory paths of the deflected plurality of ink droplets provided by the plural nozzles 5 indicates that the gas flow F is not uniform across the outlet 45 of the plenum 44. Conversely, the lack of variation in trajectory paths of the deflected plurality of ink droplets provided by the plural nozzles 5 indicates that the gas flow F is uniform across the outlet 45 of the plenum 44.

Figure 5:
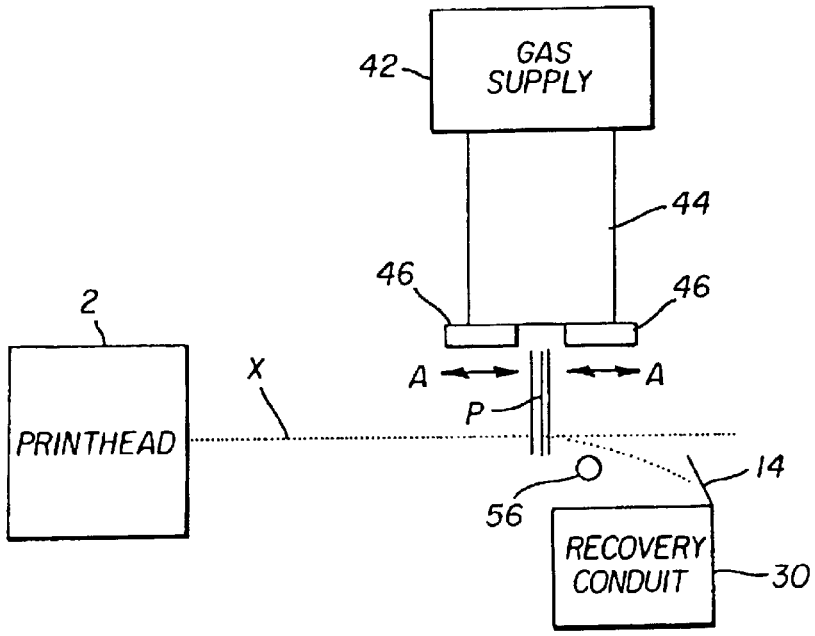
FIG. 5 is a schematic view of the printing device in accordance with another embodiment including a monitoring mechanism with a laser.

The above described monitoring of the trajectory path of the ink droplets provided by the plural nozzles 5 may be attained in various ways. FIG. 5 illustrates another embodiment where a laser (not shown) is used that provides a laser beam 56 (shown extending into the page) which is provided along the opening 45 of the plenum 44. It should be noted that the common components of the various embodiments of the present invention have been enumerated using the same numerals for clarity purposes. FIG. 5 clearly illustrates the deflection of the small ink droplets as they pass through the gas flow F. Because the position of the laser beam 56 is not impacted in any way by the gas flow F since the laser beam 56 is light, the trajectory paths of the small ink droplets provided by each of the plural nozzles 5 can be determined relative to the laser beam 56. If the trajectory paths are not the same, the gas flow F is determined to be non-uniform and the adjustment mechanism may be operated to improve uniformity of the gas flow F. Of course, the trajectory paths of the large ink droplets may also be monitored but their deflection will be less than the small ink droplets due to their increased size and volume.

Alternatively, the monitoring of the trajectory path of the ink droplets provided by the plural nozzles 5 may be attained by allowing the ink droplets provided by the plural nozzles 5 to actually impact the print medium P after they have passed through the gas flow F and observing the position of impact of the ink droplets. This is also indicative of the uniformity of the gas flow F since non-uniformity of the gas flow F will cause one or more of the ink droplets from the plural nozzles to impact the print medium P out of alignment relative to the other ink droplets impacted on the print medium P. Again, if the gas flow F is determined to be non-uniform, the adjustment mechanism may be operated to improve uniformity of the gas flow F.

In addition, in alternative embodiments of the present invention, the adjustment mechanism may also be adapted to vary the flow characteristics of the gas flow F generated by the gas source 42 of the droplet deflector 40 in various ways. In this regard, the adjustment may be attained by merely precision machining the surface of the outlet 45 according to an initial measure of uniformity, which will correspondingly alter the uniformity of the gas flow F. This precision machining would preferably be attained by laser machining which will provide relatively smooth outlet surface. For example, in regions where the gas flow is lower than necessary, more material would be removed from outlet 45, thereby increasing the width of the outlet. Whereas such adjusting of the gas flow F by machining may be appropriate and economical during the initial manufacture of the printing device 100, this method of adjusting is not preferred since it cannot be readily used by the purchaser of the printing device 100. Thus, the previously noted embodiment where the adjusting mechanism having baffles 46 is more preferred. Of course, in this regard, the baffles 46 themselves may be machined as well during the manufacturing of the print device 100 to provide a smooth outlet surface.

Figure 6:
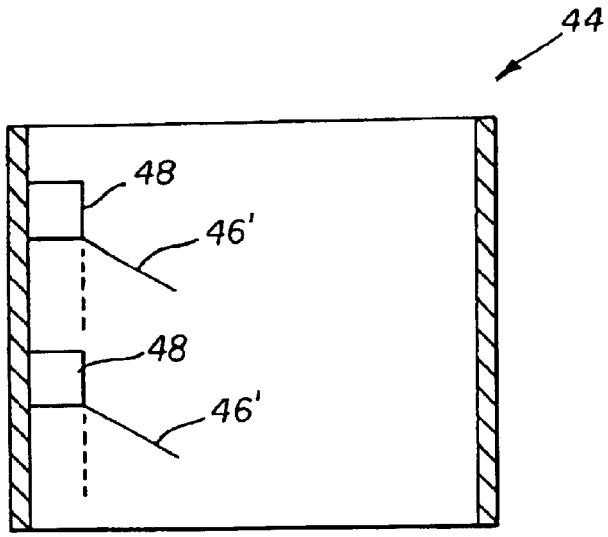
FIG. 6 is a partial sectional view of a plenum in accordance with another embodiment.

In other embodiments, the adjustment mechanism may be adapted to increase or decrease the flow rate of the gas flow F in conjunction with, or in lieu of, adjusting the flow area of the outlet 45. This may be attained as shown in FIG. 6 by providing one or more baffles 46' disposed in plenum 44 to selectively restrict the flow of gas therethrough. Baffles 46' can be activated by actuators 48 which may be piezoelectric actuators, MEMs actuators, electromagnetic solenoids, or any other type of actuators as noted above. For example, baffles 46' can be moved from a retracted position, represented by the dashed lines, to an extended position, represented by the solid lines to decrease the cross sectional area of the plenum 44 and to reduce the rate of gas flow through the plenum 44. Baffles 46' can be actuated independently or in concert with one another. Baffles 46' may be positioned at any appropriate position. This allows the printing device 100 in accordance with the present invention to improve the uniformity of the gas flow F from the plenum 44. Of course, the gas source 42 may be controlled instead or in addition to the plenum 44 in other embodiments. However, precise control of the gas source 42 will likely be expensive and not as readily controllable as the plenum 44.

Figure 7:
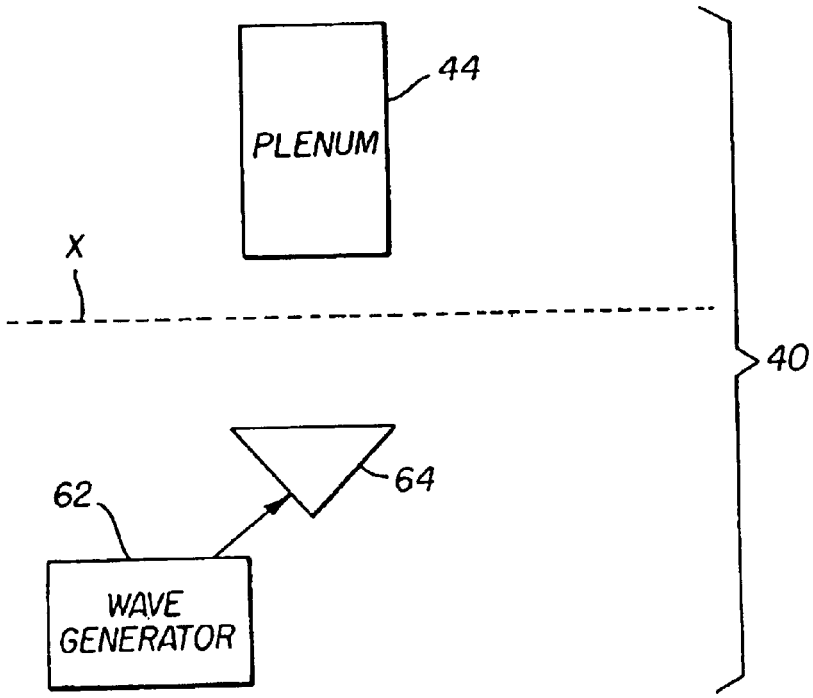
FIG. 7 is a schematic view of another embodiment of the adjustment mechanism.

FIG. 7 illustrates yet another alternative adjustment mechanism in which an acoustic wave is generated to interfere with gas flow F from plenum 44. Speaker 64 is coupled to wave generator 62 to selectively generate acoustic waves to oppose the gas flow F out of the outlet of plenum 44 and thus, impact the uniformity of the gas flow F such as by selectively restricting the velocity of the gas flow. Wave generator 62 can be controlled by controller 10 in response to the uniformity of the gas flow F which is monitored by the monitoring mechanism described previously.

It should again be noted that the illustrated embodiments discussions above provide merely examples of the present invention and the present invention is not limited thereto. In this regard, in other embodiments, droplet deflector 40 can be of any configuration and can include any number of appropriate plenums, conduits, blowers, fans, etc. Additionally, droplet deflector 40 can include a positive pressure source, a negative pressure source, or both, and can include any elements for creating a pressure gradient or gas flow. Recovery conduit 30 can be of any configuration for catching deflected droplets and can be ventilated if necessary. Gas source 42 can be any appropriate source, including a gas pressure vessel or generator, a fan, a turbine, a blower, or electrostatic air moving device. The baffles 46 can be of any size, shape, or configuration and in fact, the adjustment mechanism may also be orifices, templates, or the like.

Print media P can be of any type and in any form. For example, the print media can be in the form of a web or a sheet. Additionally, print media P can be composed from a wide variety of materials including paper, vinyl, cloth, other large fibrous materials, etc. Any mechanism can be used for moving the printhead relative to the media, such as a conventional raster scan mechanism, etc.

Figure 8:
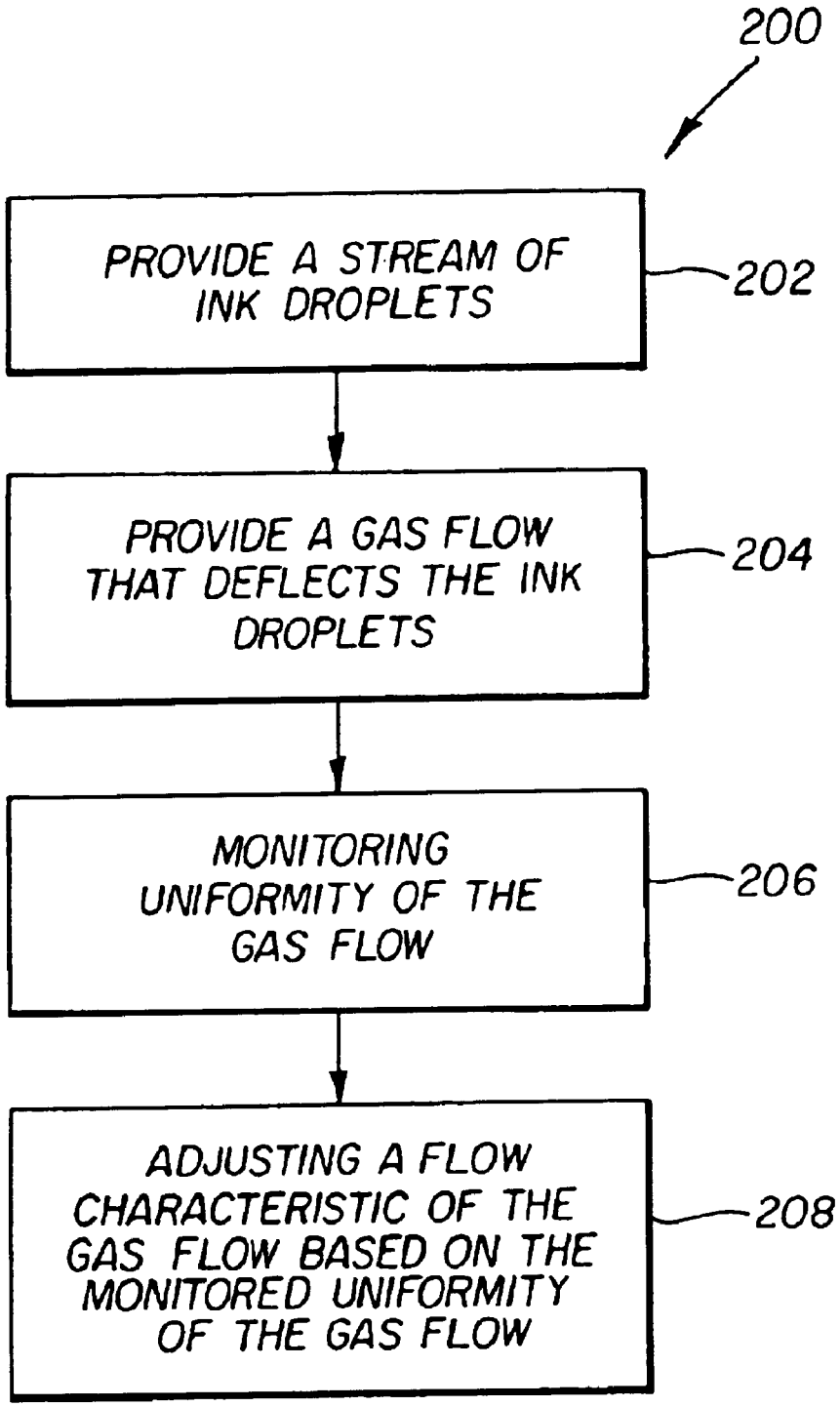
FIG. 8 is a flow diagram of the method of enhancing print quality of a continuous ink jet printing device in accordance with one embodiment of the present invention.

As can be readily appreciated from the discussion above, the present invention also provides a novel method of enhancing print quality of a continuous ink jet printing device in which selected droplets in a stream of droplets are selectively deflected to impinge on a print medium. The method in accordance with the present invention is more clearly illustrated in flow diagram 200 shown in FIG. 8. As can be seen, the method includes step 202 in which a stream of plurality of ink droplets is provided, each ink droplet being substantially same size, whether it be small droplets or large droplets. A gas flow that deflects the plurality of ink droplets is provided in step 204. The uniformity of the gas flow is monitored in step 204, and a flow characteristic of the gas flow is adjusted in step 206 based on the monitored uniformity of the gas flow of step 204.

It should be evident that the various steps shown in the flow diagram 200 may be attained using the printing device as described relative to FIGS. 1 to 7 previously. In this regard, the gas flow may be generated by a droplet deflector. The step 204 of monitoring uniformity of gas flow may be attained by the hot-wire sensor or by monitoring trajectory paths of the deflected plurality of ink droplets in the manner previously described such as by using a laser beam or by impacting the partially deflected plurality of ink droplets on a print media. Moreover, the gas flow may be adjusted in step 206 by changing the flow rate or the flow area of the outlet such as by operating baffles. In another embodiment, the flow characteristic of the gas flow may be adjusted by generating an acoustic wave or alternatively, by precision machining the outlet.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as by the following claims and their legal equivalents.

PARTS LIST

2 Printhead
4 Heaters
5 Nozzles
6 Pad
7 Drop forming mechanism
8 Conductor
10 Controller
11 Logic Section
12 Sensor
14 Gutter or catcher
20 Ink Supply
30 Recovery Conduit
40 Droplet Deflector
42 Gas Source
43 Force
44 Plenum
45 Outlet
46 Baffles
46' Baffles
48 Actuators
55 Filament
56 Laser Beam
60 Acoustic Wave Generator
64 Speaker
62 Wave Generator
100 Printing device
102 Small Droplet
104 Large Droplet

We claim:

1. A method of enhancing print quality of a continuous ink jet printing device in which selected droplets in a stream of droplets are selectively deflected to impinge on a print medium comprising the steps of:

providing a plurality of ink droplets, each ink droplet being substantially same size and velocity;

providing a gas flow that deflects said plurality of ink droplets;

monitoring uniformity of said gas flow; and adjusting a flow characteristic of said gas flow based on said monitored uniformity of said gas flow.

2. The method of claim 1, wherein said gas flow is generated by a droplet deflector having an outlet, and said gas flow is provided through said outlet.

3. The method of claim 2, wherein said step of adjusting flow characteristic of said gas flow is attained by changing at least one of a flow rate of said gas flow and a flow area of said outlet.

4. The method of claim 3, wherein said step of adjusting flow characteristic of said gas flow is attained by at least one of increasing flow rate of said gas flow and decreasing flow rate of said gas flow.

5. The method of claim 3, wherein said step of adjusting flow characteristic of said gas flow is attained by generating an acoustic wave to oppose said gas flow.

6. The method of claim 3, wherein said step of adjusting flow characteristic of said gas flow is attained by actuating an adjustment mechanism that adjustably varies at least one of a flow rate of said gas flow and a flow area of said outlet.

7. The method of claim 3, wherein said step of adjusting flow characteristic of said gas flow is attained by precision machining said outlet.

8. The method of claim 1, wherein said step of monitoring uniformity of gas flow is attained by a sensor which measures relative heat loss to the gas flow.

9. The method of claim 1, wherein said step of monitoring uniformity of gas flow includes monitoring trajectory paths of said deflected plurality of ink droplets.

10. The method of claim 9, wherein lack of variation in trajectory paths of said deflected plurality of ink droplets is indicative of uniform gas flow, and presence of variation in trajectory paths of said plurality of ink droplets is indicative of non-uniform gas flow.

11. The method of claim 10, wherein said step of monitoring trajectory paths of said deflected plurality of ink droplets includes providing a light beam across said gas flow and monitoring trajectory paths of said plurality of ink droplets relative to said light beam.

12. The method of claim 10, wherein said step of monitoring trajectory paths of said deflected plurality of ink droplets includes impacting said deflected plurality of ink droplets on a print media and comparing location of said plurality of ink droplets on said print media.

13. A method of monitoring uniformity of gas flow in a continuous ink jet printing device comprising the steps of:

providing a plurality of ink droplets, each ink droplet being substantially same size;

providing a gas flow that deflects said plurality of ink droplets; and monitoring trajectory paths of said deflected plurality of ink droplets to determine gas flow uniformity;

wherein lack of variation in trajectory paths of said deflected plurality of ink droplets is indicative of uniform gas flow, and presence of variation in trajectory paths of said deflected plurality of ink droplets is indicative of non-uniform gas flow.

14. The method of claim 13, wherein said step of monitoring trajectory paths of said deflected plurality of ink droplets includes providing a light beam across said gas flow and monitoring trajectory paths of said deflected plurality of ink droplets relative to said light beam.

15. The method of claim 13, wherein said step of monitoring trajectory paths of said deflected plurality of ink droplets includes impacting said deflected plurality of ink droplets on a print media and comparing location of said deflected plurality of ink droplets on said print media.

16. The method of claim 13, wherein said gas flow is generated by a droplet deflector having an outlet, said gas flow being provided through said outlet, and further including the step of adjusting a flow characteristic of said gas flow by changing at least one of a flow rate of said gas flow and a flow area of said outlet.

17. The method of claim 16, wherein said step of adjusting flow characteristic of said gas flow is attained by generating an acoustic wave to oppose said gas flow.

18. The method of claim 16, and said step of adjusting flow characteristic of said gas flow is attained by actuating an adjustment mechanism that adjustably varies said flow area of said outlet.

19. The method of claim 18, wherein said step of adjusting flow characteristic of said gas flow is attained by precision machining said outlet.

20. A continuous ink jet printing device for printing an image in which selected droplets in a stream of droplets are selectively deflected to impinge on a print medium, said printing device comprising:

an ink droplet forming mechanism adapted to provide plurality of ink droplets, each ink droplet being substantially same size;

a droplet deflector with an outlet, said droplet deflector being adapted to generate a gas flow provided through said outlet that deflects said plurality of ink droplets;

a monitoring mechanism adapted to monitor uniformity of said gas flow from said droplet deflector; and an adjustment mechanism operatively coupled to said droplet deflector to adjust a flow characteristic of said gas flow based on said monitored uniformity of said gas flow.

21. The printing device of claim 20, wherein said adjustment mechanism changes at least one of a flow rate of said gas flow generated by said droplet deflector and a flow area of said outlet.

22. The printing device of claim 21, wherein said adjustment mechanism at least one of increases flow rate of said gas flow and decreases flow rate of said gas flow.

23. The printing device of claim 21, wherein said adjustment mechanism generates an acoustic wave to oppose said gas flow.

24. The printing device of claim 21, wherein said adjustment mechanism includes a baffle which is movable between a retracted position and an extended position to vary at least one of a flow rate of said gas flow generated by said droplet deflector and a flow area of said outlet.

25. The printing device of claim 24, wherein said baffle is moved by an actuator.

26. The printing device of claim 25, wherein said baffle is moved by said actuator to vary said flow area of said outlet.

27. The printing device of claim 20, wherein said monitoring mechanism includes a thermal conductivity type sensor.

28. The printing device of claim 20, wherein said monitoring mechanism monitors trajectory paths of said deflected plurality of ink droplets.

29. The printing device of claim 28, wherein lack of variation in trajectory paths of said deflected plurality of ink droplets is indicative of uniform gas flow, and presence of variation in trajectory paths of said plurality of ink droplets is indicative of non-uniform gas flow.

30. The printing device of claim 29, wherein said monitoring mechanism includes a light source that provides a light beam across said gas flow to allow monitoring trajectory paths of said plurality of ink droplets relative to said light beam.

31. A method of enhancing print quality of a continuous ink jet printing device in which selected droplets in a stream of droplets are selectively deflected to impinge on a print medium comprising the steps of:

providing a plurality of ink droplets, each ink droplet being substantially same size and velocity;

providing a gas flow that deflects said plurality of ink droplets;

monitoring uniformity of said gas flow; and adjusting a flow characteristic of said gas flow based on said monitored uniformity of said gas flow, wherein said step of monitoring uniformity of gas flow is attained by a sensor which measures relative heat loss to the gas flow.

32. A method of enhancing print quality of a continuous ink jet printing device in which selected droplets in a stream of droplets are selectively deflected to impinge on a print medium comprising the steps of:

providing a plurality of ink droplets, each ink droplet being substantially same size and velocity;

providing a gas flow that deflects said plurality of ink droplets;

monitoring uniformity of said gas flow; and adjusting a flow characteristic of said gas flow based on said monitored uniformity of said gas flow, said step of monitoring uniformity of gas flow including monitoring trajectory paths of said deflected plurality of ink droplets, said step of monitoring trajectory paths of said deflected plurality of ink droplets including providing a light beam across said gas flow and monitoring trajectory paths of said plurality of ink droplets relative to said light beam, wherein lack of variation in trajectory paths of said deflected plurality of ink droplets is indicative of uniform gas flow, and presence of variation in trajectory paths of said plurality of ink droplets is indicative of non-uniform gas flow.

33. A method of monitoring uniformity of gas flow in a continuous ink jet printing device comprising the steps of:

providing a plurality of ink droplets, each ink droplet being substantially same size;

providing a gas flow that deflects said plurality of ink droplets; and monitoring trajectory paths of said deflected plurality of ink droplets to determine gas flow uniformity;

wherein lack of variation in trajectory paths of said deflected plurality of ink droplets is indicative of uniform gas flow, and presence of variation in trajectory paths of said deflected plurality of ink droplets is indicative of non-uniform gas flow, and said step of monitoring trajectory paths of said deflected plurality of ink droplets includes providing a light beam across said gas flow and monitoring trajectory paths of said deflected plurality of ink droplets relative to said light beam.

34. A continuous ink jet printing device for printing an image in which selected droplets in a stream of droplets are selectively deflected to impinge on a print medium, said printing device comprising:

an ink droplet forming mechanism adapted to provide plurality of ink droplets, each ink droplet being substantially same size;

a droplet deflector with an outlet, said droplet deflector being adapted to generate a gas flow provided through said outlet that deflects said plurality of ink droplets;

a monitoring mechanism adapted to monitor uniformity of said gas flow from said droplet deflector; and an adjustment mechanism operatively coupled to said droplet deflector to adjust a flow characteristic of said gas flow based on said monitored uniformity of said gas flow, wherein said monitoring mechanism includes a thermal conductivity type sensor.

35. A continuous ink jet printing device for printing an image in which selected droplets in a stream of droplets are selectively deflected to impinge on a print medium, said printing device comprising:

an ink droplet forming mechanism adapted to provide plurality of ink droplets, each ink droplet being substantially same size;

a droplet deflector with an outlet, said droplet deflector being adapted to generate a gas flow provided through said outlet that deflects said plurality of ink droplets;

a monitoring mechanism adapted to monitor uniformity of said gas flow from said droplet deflector; and an adjustment mechanism operatively coupled to said droplet deflector to adjust a flow characteristic of said gas flow based on said monitored uniformity of said gas flow, said monitoring mechanism monitoring trajectory paths of said deflected plurality of ink droplets, said monitoring mechanism including a light source that provides a light beam across said gas flow to allow monitoring trajectory paths of said plurality of ink droplets relative to said light beam, wherein lack of variation in trajectory paths of said deflected plurality of ink droplets is indicative of uniform gas flow, and presence of variation in trajectory paths of said plurality of ink droplets is indicative of non-uniform gas flow.

* * * * *